United States Patent [19]

Fields

[11] Patent Number: 4,683,741

[45] Date of Patent: Aug. 4, 1987

[54] LIGHT SIGNAL FOR DOOR KNOB AND LOCK ASSEMBLY

[76] Inventor: Roy A. Fields, 51 Thompson St., Tuckahoe, N.Y. 10707

[21] Appl. No.: 885,420

[22] Filed: Jul. 14, 1986

[51] Int. Cl.[4] ..... E05B 41/00

[52] U.S. Cl. ..... 70/432; 70/441; 109/38

[58] Field of Search ..... 70/431, 432, 330, 434, 70/441; 109/21, 31, 38; 200/61.64; 340/815.23

[56] References Cited

U.S. PATENT DOCUMENTS 3,427,835 2/1969 Jeffee ..... 70/432
4,559,796 12/1985 DeForrest ..... 70/432

FOREIGN PATENT DOCUMENTS 86806 7/1977 Australia ..... 70/432
WO82/2861 9/1982 World Int. Prop. O. ..... 70/432

*Primary Examiner*—Robert L. Wolfe
*Attorney, Agent, or Firm*—Myron Amer

[57] ABSTRACT

A door knob and lock assembly having a pair of knobs, a latching bolt operable by the rotation of the knobs, and a turn button to selectively arrest the movement of the bolt to place the assembly in locked condition. A battery operated electrical circuit including a switch operable by the turn button, and a light emitting diode mounted within the door knobs so as to be operable on locking the door to provide a flashing light visible from the outside of the door.

2 Claims, 8 Drawing Figures

LIGHT SIGNAL FOR DOOR KNOB AND LOCK ASSEMBLY

BACKGROUND OF THE INVENTION

The present invention relates to combined door knob and lock for installation on bathroom, toilet and similar compartment doors where closure from inside the room is required.

In the haste to make use of bathrooms and toilets, for example, a user is frequently unaware that the facility is at that moment in use, and the user vigorously pushes and shakes the door in an attempt to gain entry. Often precious moments are lost before the user realizes he must seek another facility to his annoyance and after disturbing the prior occupant as well.

In U.S. Pat. No. 3,427,835 a locking mechanism for double swinging doors is shown in which an attempt is made at providing a signal of occupancy. Such arrangement is briefly illustrated in FIG. 1 of the attached drawings. One of the swinging doors 10 is provided with a more or less standard linear throw lock mechanism 12 having a knob 14, a latch 16, and a lever operated throw bolt 18 while the other door 20 has built into it a switch mechanism 22 having a plunger 24 extending out of the door edge in alignment with the bolt 18. When the bolt 18 is thrown into closing position it engages the plunger 22 operating the switch mechanism 22, which is connected via an electrical circuit to a lamp 26, fitted into the face of the door 20 so that the lamp 26 is lit when the plunger 22 is depressed. According to this patent, the switch mechanism 22 includes a transformer, switch and rectifier circuit requiring complex electric installations and a source of house current remote from the door itself.

A major drawback of the arrangement described in the foregoing patent is the fact that two major independent mechanical lock components are required, namely, the lock-latch device set in door 10 and switch device set in door 20, as well as the separate light indicator. In addition, the separate light indicator requires cutting of at least one hole in the face of one door. The device further requires alignment of the bolt and the plunger in each door so as to meet during normal operation of the door.

It is the object of the present invention to overcome the disadvantages and drawback of the prior art and to provide an improved door lock with light indicator.

It is a further object to provide a lock for bathroom or toilet facilities which is simple in construction and in installation and which is extremely low in cost.

Another object is to provide a lock of the aforementioned type which runs on batteries and is otherwise self-contained and does not require expensive security or electrical installation.

These objects together with other objects will be apparent from the following disclosure.

SUMMARY OF THE INVENTION

According to the present invention, an improved light signal for a room door lock is provided to indicate the locked or unlocked condition thereof, wherein the room door has a compartment and a door lock of the type operable between a locked and unlocked condition disposed in the compartment. A battery operated electrical circuit is electrically connected to the door lock so as to be electrically completed in the locked condition of the door. A light signal is electrically connected in the electrical circuit and is mounted in a location for display that is restricted to the immediate vicinity of the door lock so as to be readily associated therewith. The light signal is specifically a light emitting diode of the type having a flashing operational mode, whereby the light of the diode when turning from off to on contributes with the display location to draw attention thereto, and when then turning from on to off prolongs the life of the battery.

Preferably the improvement is incorporated into a door knob and lock assembly having a pair of knobs and a latching bolt operable by the rotation of the knobs. One of the knobs is provided with means for selectively arresting the movement of the bolt to place the assembly in locked condition. The battery operated electrical circuit includes switch means operable by the turn button, and the light emitting diode is mounted within the door knob so as to be visible from the exterior of the door and the battery and flasher are mounted within the conventional latch bolt casing.

In further detail, the switch means is mounted within the conventional face plate, by which the knobs are secured to the face of the door and is thereby enclosed and hidden from view.

Full details of the present invention are shown in the accompanying drawing and described in the following description.

DESCRIPTION OF THE INVENTION

Figure 1:
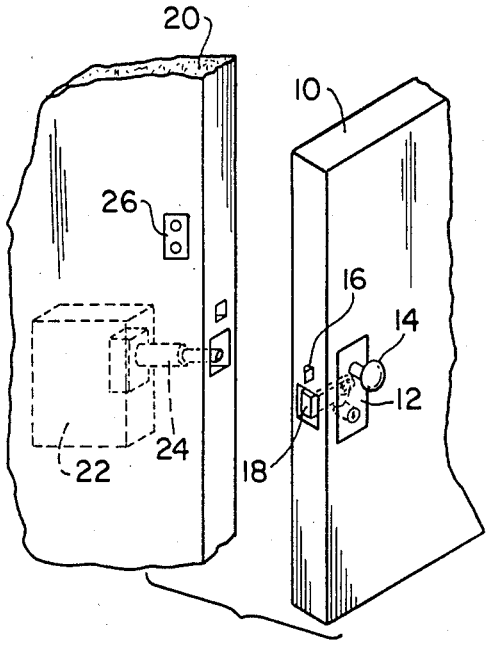
Fig.1 PRIOR ART
FIG. 1 is an isometric view of the device of the prior art.

The present invention is illustrated in the drawing as applied to one example of a conventional dead latch door knob and lock assembly for a bathroom or similar room where the ability to lock the door, for privacy, from the interior is required.

Figure 2:
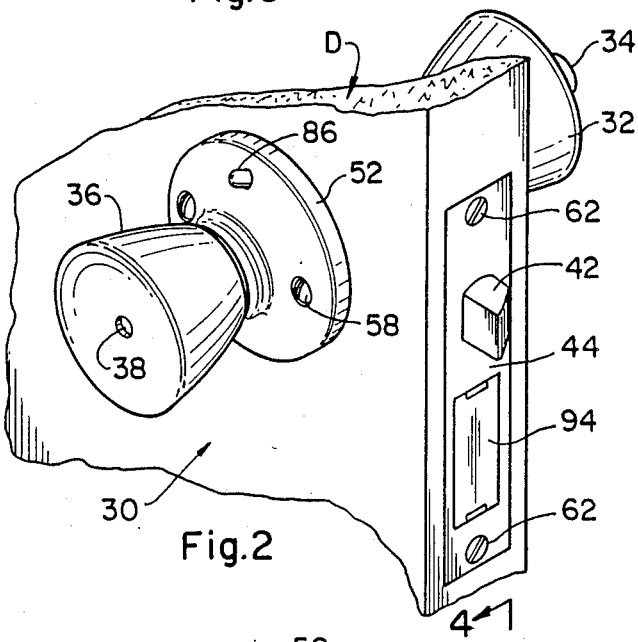
FIG. 2 is an isometric view of a room door lock assembly incorporating the light signal of the present invention.
Figure 3:
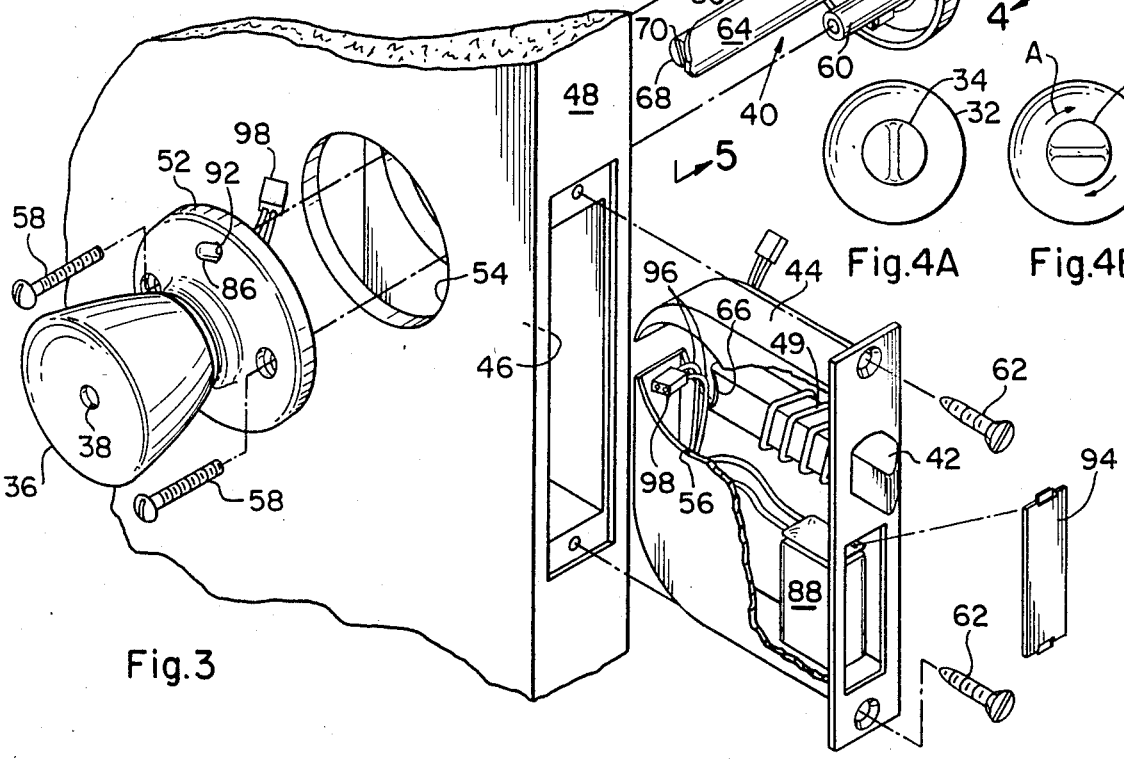
FIG. 3 is an exploded isometric view of the assembly and light signal shown in FIG. 2.

As seen in FIGS. 2 and 3, the exemplary assembly generally depicted by the numeral 30 is mounted in a conventional door D hung within a fixed frame (not shown). The assembly comprises an inside knob 32 provided with a depressible turn button 34 and an outside knob 36, which is provided with a hole 38 permitting entry of a special tool, enabling disconnection of the assembly in the event of any emergency which would require opening of the door from the exterior.

Otherwise the outside knob 36 is free of any buttons, or key holes.

Each of the knobs 32 and 36 are provided with interengaging mechanical components, generally depicted by the numeral 40, operative to control the movement of a latch bolt 42, located in a casing 44, set into a cavity 46 opening from the outer edge 48 of the door. The latch bolt 42 is biased by a spring 49 to normally enter into an apertured striker plate (not illustrated) mounted on the fixed frame when the door is swung closed. The knobs 32 and 36 are rotatively held on cup shaped face plates 50 and 52 respectively, and are attached to the door by passing the internal mechanical component through a hole 54 in the door and an aligned hole 56 in the casing 44. The two knobs 32 and 36 are secured to the door as well as to each other by screws 58 passing through the outside face plate 52 entering into threaded posts 60 formed integrally with the inside face plate 50. The casing 44 is secured to the door by screws 62.

As seen in FIG. 3, the mechanical control components 40, include a crescent shaped blade 64, fixedly secured to the inside knob 32 and extending coaxially from the knob 32 into a similarly shaped slot in the outside knob 36, passing first through a crescent slot 66 formed in the inner end of the latch bolt 42 so that conjoint rotation of the knobs 32 and 36 can be effected and translated into linear movement of the latch bolt 42, allowing the latch bolt 42 to be retracted into the casing 44 on simple turning of either knob 32 and 36 against the bias of the spring 49.

As seen in FIG. 3, a spindle 68 is integrally connected to the depressible turn button 34 extending inwardly from the inside knob 32, along its central axis. The spindle 68 is provided with a longitudinal spline 70. An annular locking plate 72 slidably fits over the spindle 68 and freely seats within the interior of the cup shaped face plate 50. The locking plate 72 is provided with a radially inward detent (not shown) forming a key fitting into the spline 70 so that on turning of the turn button 34, the integral spindle 68 also rotates the locking plate 72.

Figure 4A:
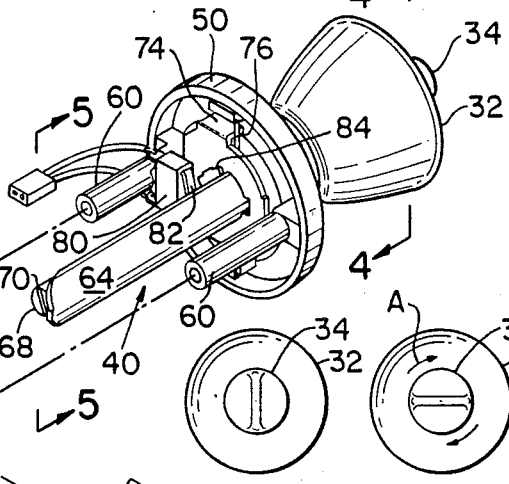
FIG. 4A is an end view of the inside knob taken in the direction of line 4—4 of FIG. 3 illustrating the unlocked position of the push button.
Figure 4B:
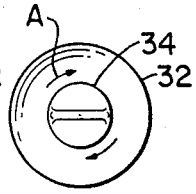
FIG. 4B is a view similar to FIG. 4A showing the locked position of the push button.

The locking plate 72 is also provided with a radially outward tab 74 located between a pair of perpendicularly disposed stops 76 and 78, both integrally formed on the inner surface of face plate 50. Thus, the movement of locking plate 72 is limited to a 90 degree arc which, as seen in FIGS. 4A and 4B, may be translated into a vertical position and a horizontal position for the turn button 34 when the door lock is assembled and mounted on the door so that the stop position 76 is in the upper central position (12 o'clock, if reference to a clock face is made). Such disposition is, of course, not critical, and while many installations do not conform thereto, it is conventional to refer to the positions of the turn button, as vertical and horizontal being the equivalent of unlocked and locked positions.

Figure 5A:
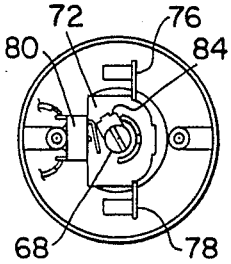
FIG. 5A is a sectional view taken along line 5—5 of FIG. 3 showing the condition of the switch mechanism of the light assembly in the unlocked position of the push button.
Figure 5B:
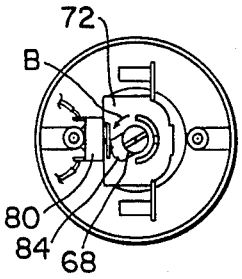
FIG. 5B is a view similar to FIG. 5A showing the condition of the switch mechanism in the locked position of the push button.

Located within the inside knob 32 are catch means (not shown) which, upon depression and turning of the turn button 34 to its full clockwise direction, (arrow A as shown in drawing FIG. 4B), holds the turn button 34 and both knobs 32 and 36 against rotation in either direction and thus "locks" the assembly against retraction of the latch bolt 42. The door lock thus remains locked so long as the turn button 34 is so positioned, and is releasable only upon further depression and counter clockwise rotation of the turn button 34. It will be noted that since FIGS. 5A and 5B are reverse sides of the face plate 50, the directional arrow in FIG. 5 depicting rotation of the turn button and integral shaft are reversed from that of FIG. 4A and FIG. 4B.

The door lock assembly so far described is conventional and more specific details can be had by reference to any commercially available device, found for instance in any hardware store. The details so far described are not to be taken as critical, as in some commercial devices, parts may be reversed, modified and replaced with others having the same or similar function.

In accordance with the present invention, the apparatus for indicating whether the door is in locked or unlocked condition comprises a small micro-switch 80 (FIG. 3) secured in fixed position on one of the threaded posts 60 so that its spring contact 82 lies in opposition to the splined spindle 68. Fixed on the spindle 68 in alignment with the contact 82 is a cam 84 having a shaped edge adapted to ride on and despress the contact 82 as the turn button 34 is rotated from its normally unlocked to locked position as seen in FIGS. 5A and 5B.

Figure 6:
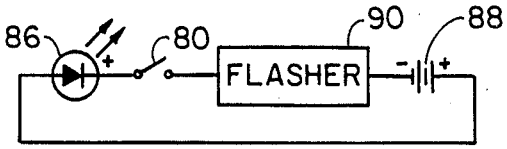
FIG. 6 is an electrical circuit diagram for operating the light signal.

As seen in FIG. 6, the micro-switch 80 is connected to a light emitting diode (LED) 86 and to a source of current such as a battery 88 and in circuit with a solid state flashing device 90. The LED 86 is mounted in a small hole 92 situated in the outside face plate 52 in close proximity to the door knob 36 preferably so as to be clearly related to it, and in full view of the person approaching the door. The micro-switch 80 is normally an open switch, making closed contact on depression of its contact 82 by the cam 84. Upon closing of micro-switch 80, current flows to the LED 86 through the flasher unit 90. In this manner, the flashing of the LED will be immediate, and an ever present signal that the door is locked and the bathroom in use. A subsequent user will have no need to attempt to turn the door knob or shake the door.

To accomodate the battery 88, the edge face of the casing 44 is provided with a removable closing plate 94 behind which the battery 88 and the flasher unit 90 can be secreted and from which suitable low voltage wire 96 can extend through the hole 56 to the micro-switch 80 and LED 86. The wire 96 is preferably provided with polarized plug and socket connectors 98 allowing modular assembly of the components. Various arrangements of LED and flasher units are commercially avaiable and reference to any handbook or commercial supplier catalogue will provide ample details of such. LEDs have extremly low power, as well as low voltage drive requirements and are amply suited for long term use. The use of a flasher not only creates a readily visual indicator by creating a blinking light, but also contributes to reducing drain on the battery source by reducing power consumption, thus prolonging its life by turning from on to off periodically.

In general, the known casings are usually larger than actually required to house the latch bolt and its biasing spring. Therefore, the location of the battery 88 and the flasher 90 within the casing as shown will present no problem. On the other hand, a small casing may be enlarged or replaced without any significant added cost to the door lock assembly or its installation in the door. Similarly, the installation of the LED 86 in the face plate 52 is likewise simple as the hole 92 need be only a small one and may be easily made during fabrication of the face plate or even in situ by the use of an ordinary hand drill. The LED may be retained in the recess 92 by use of small amounts of epoxy adhesive or the like. While it is preferred that the LED by mounted in the face plate on the outside surface of the door, the LED may be located elsewhere, as for example in the outside knob itself.

From the foregoing, it should be appreciated that there has been described herein a visual signal that is particularly suitable and advantageous for use on the door of a lavatory. More particularly, among other advantages as described herein, the visual signal gives a sense of security to the occupant of a lavatory in that he or she will not be disturbed by a knock or an oral inquiry as to whether the lavatory is occupied.

There is also a benefit to deaf or hard of hearing persons who are incapable of hearing any auditory inquiry whether the person is outside or inside the lavatory.

It is to be understood that the present invention can be applied to other conventional door lock assemblies, having different mechanical structure, provided at least one element in the locking mechanism is movable (rotatably or linearly) and has sufficient room for a micro switch to be mounted in opposition to it. Therefore, the present disclosure is to be taken as illustrative only and not limiting of the scope of this invention.

What is claimed is:

1. In a door knob and lock assembly for a bathroom door having one of a pair of knobs on the exterior and one on the interior of said bathroom door and a latching bolt operable by the rotation of the knobs, said one of the knobs on the interior of said bathroom door being provided with a turn button operable to selectively arrest the movement of the bolt to place the assembly in locked condition, the improvement comprising a battery operated electrical circuit for indicating only said locked condition of said assembly, said circuit including switch means operable by the turn button to activate a light emitting diode, said light emitting diode being mounted in conjunction with said one door knob on the exterior of said bathroom door so as to be visible from the exterior of the door.

2. The door knob and lock assembly according to claim 1, wherein said electrical circuit includes a flasher unit for causing said light emitting diode to blink.

* * * * *